US010149557B2

(12) United States Patent
Vestergaard

(10) Patent No.: US 10,149,557 B2
(45) Date of Patent: Dec. 11, 2018

(54) FRAME

(71) Applicant: Projecktmetier v/ Stig Vestergaard, Frederiksberg C (DK)

(72) Inventor: Stig Vestergaard, Frederikbserg C (DK)

(73) Assignee: PROJECKTMETIER V/ STIG VESTERGAARD (DK)

( * ) Notice: Subject to any disclaimer, the term of this patent is extended or adjusted under 35 U.S.C. 154(b) by 0 days.

(21) Appl. No.: 15/110,506

(22) PCT Filed: Jan. 9, 2015

(86) PCT No.: PCT/DK2015/000002
§ 371 (c)(1),
(2) Date: Jul. 8, 2016

(87) PCT Pub. No.: WO2015/104023
PCT Pub. Date: Jul. 16, 2015

(65) Prior Publication Data

US 2016/0324340 A1 Nov. 10, 2016

(30) Foreign Application Priority Data

Jan. 10, 2014 (DK) ..... 2014 00013

(51) Int. Cl.
*A47G 1/06* (2006.01)

(52) U.S. Cl.
CPC ..... *A47G 1/06* (2013.01); *A47G 1/0605* (2013.01); *A47G 2001/0677* (2013.01)

(58) Field of Classification Search
CPC ..... A47G 1/0605; A47G 1/0611; A47G 1/06
See application file for complete search history.

(56) References Cited

U.S. PATENT DOCUMENTS 1,246,095 A * 11/1917 Herrmann ..... A47G 1/0605 40/792
3,178,014 A * 4/1965 Goldwasser ..... 206/0.83
(Continued)

FOREIGN PATENT DOCUMENTS

DE 2314030 A1 * 3/1973 ..... A47G 1/0605
DE 29923742 U1 2/2001
DE 202005017234 U1 12/2005

OTHER PUBLICATIONS

PCT International Search Report and Written Opinion in PCT/DK2015/000002 dated May 28, 2015, 10 pages.
(Continued)

*Primary Examiner* — Cassandra Davis
(74) *Attorney, Agent, or Firm* — Ware, Fressola, Maguire & Barber LLP

(57) ABSTRACT

A frame (2) for framing a picture/an artwork (4) having a periphery (8) is disclosed. The frame (2) comprises a contact surface (10) provided at the inside (12) of the frame, which frame (2) comprises an opening (14), through which the picture/artwork (4) is mountable. At least one flexible member (6, 6', 6", 6'") extends along at least a portion of the contact surface (10). The at least one flexible member (6, 6', 6", 6'") is provided in such a manner that the flexible member (6, 6', 6", 6'") is configured to securely maintain the picture/artwork (4) within the frame (2) by means of a compression force ($F_1$) and/or a friction force ($F_2$) between the at least one flexible member (6, 6', 6", 6'") and the periphery (8). The flexible member (6, 6', 6", 6'") is compressible. The flexible member (6, 6', 6", 6'") is attached to the frame (2) in such a manner that the flexible member (6, 6', 6", 6'") is restricted from being moved along the width (axis X) of the contact face (10).

20 Claims, 9 Drawing Sheets

(56) References Cited

U.S. PATENT DOCUMENTS

| | | | | |
|---|---|---|---|---|
| 3,665,627 | A * | 5/1972 | MacCluney | A47G 1/06 40/779 |
| 4,319,420 | A | 3/1982 | Clinton | |
| 4,583,309 | A * | 4/1986 | Kane | A47G 1/0655 40/711 |
| 5,100,178 | A * | 3/1992 | MacKelvie | B42D 5/005 281/44 |
| 5,524,370 | A * | 6/1996 | Roy | A47G 1/06 40/748 |
| 5,974,714 | A | 11/1999 | Jones | |
| 6,341,702 | B1 * | 1/2002 | MacKelvie | A47B 81/068 211/40 |
| 6,354,031 | B1 * | 3/2002 | Meur | G09F 15/0012 40/732 |
| 7,069,682 | B2 * | 7/2006 | Gatt | A47G 1/06 40/700 |
| 2003/0046849 | A1 | 3/2003 | Lin | |
| 2005/0268510 | A1 | 12/2005 | Humphrey | |
| 2006/0021273 | A1 * | 2/2006 | Cuderman | A47G 1/0605 40/780 |
| 2012/0210621 | A1 | 8/2012 | Huang et al. | |
| 2013/0086779 | A1 | 4/2013 | Florea | |

OTHER PUBLICATIONS

PCT International Preliminary Report on Patentability in PCT/DK2015/000002 dated Jul. 12, 2016, 7 pages.

* cited by examiner

FRAME

CROSS REFERENCE TO RELATED APPLICATIONS

This is a National Phase entry of International Application No. PCT/DK2015/000002, filed Jan. 9, 2015, which claims priority to Danish Application No. PA 2014 00013, filed Jan. 10, 2014, the disclosures of which are incorporated herein by reference in their entireties.

FIELD OF INVENTION

The present invention relates to a frame for framing pictures/artworks, such as photographs, posters and canvases.

PRIOR ART

When mounting a picture/artwork into a frame it is possible to apply so-called floater frames which create the illusion that the artwork is "floating" within the frame instead of being covered by it. The "floating illusion" is created by providing a gap between the frame and the edge of the picture/artwork. Typically, a floater frame comprises four L-profiles joined together at the corners of the frame.

The picture/artwork is attached to the back portion of the frame in a manner in which the attachment is not visible from the front side of the frame. It is extremely difficult to mount a picture/artwork in a perfect symmetrical way due to the fact that the person mounting the image has no visual inspection of the front during the mounting process.

Furthermore, successful use of the prior art floater frames requires that the frames and the picture/artwork are a perfect fit. Moreover, it is time-consuming and difficult to mount a picture/an artwork in prior art floater frames which are also rather heavy.

US 2003/0046849 A discloses a carrier frame comprising L-shaped frame members. A plurality of displaceable structures are provided at the inside portion of the frame. This structure is adapted to press against a picture/artwork and hereby generate a force to keep the picture/artwork in place within the frame. In order to mount a picture/artwork in the frame, the plurality of displaceable structures at each frame member must be displaced at the same time. This is very difficult in practice. Moreover, the picture/artwork can only be mounted to the frame from one side.

Thus, there is a need for a frame which enables an easier and more user-friendly mounting of a picture/an artwork and which reduces or even eliminates the above-mentioned disadvantages of the prior art.

Accordingly, it is an object of the present invention to provide a frame that is easy and fast to use for the purpose of mounting a picture/artwork.

Moreover, it is an object of the present invention to provide a frame in which it is possible to mount a picture/an artwork from both sides of the frame.

Furthermore, it is an object of the present invention to provide a frame adapted to fit pictures of different thicknesses and sizes.

It is also an object of the present invention to provide a frame that is lighter than the prior art floater frames.

SUMMARY OF THE INVENTION

The object of the present invention can be achieved by a frame as defined in claim 1. Preferred embodiments are defined in the dependent sub claims, explained in the following description and illustrated in the accompanying drawings.

The frame according to the invention is a frame for framing a picture/an artwork having a periphery, which frame comprises a contact surface provided at the inside of the frame, which frame comprises an opening through which the picture/artwork is mountable, wherein at least one flexible member extends along at least a portion of the contact surface, where the at least one flexible member is provided in such a manner that the flexible member is configured to securely maintain the picture/artwork within the frame by means of a compression force and/or a friction force provided between the at least one flexible member and the periphery, wherein the flexible member is attached to the frame in such a manner that the flexible member is restricted from being moved along the width of the contact face.

Hereby, it is possible to provide a frame that is easy and fast to use for the purpose of mounting a picture/an artwork.

Furthermore, the invention makes it possible to provide a frame adapted to fit pictures of different thicknesses and sizes.

Moreover, it is possible to provide a simpler and lighter frame than the prior art floater frames.

The invention makes it possible to frame a picture/an artwork in a manner in which the picture/artwork is centrally positioned within the frame.

Since the flexible member is attached to the frame in such a manner that the flexible member is restricted from being moved along the width (axis X) of the contact face, the position of the picture/artwork may be adjusted along the width of the frame members (along the axis X in FIG. 2) in a manner in which the flexible member is kept attached to the frame.

Accordingly, the picture/artwork can be positioned in such a manner that the front side of the frame and of the picture/artwork are aligned in order to create the illusion that the picture/artwork is "floating" within the frame. It is also possible to mount the picture/artwork deeper within the frame in order to be able to mount a glass plate in front of the picture/artwork.

In case that the frame is wider than the picture/artwork, the picture/artwork may be arranged between the back side and the front side periphery of the frame in order to protect the picture/artwork during transportation or storage. In that way, adjacent pictures/artworks are prevented from getting into direct contact with each other.

The at least one flexible member also protects the picture/artwork if the frame is accidently dropped as the flexible member may be shock-absorbing and thus may reduce or eliminate damage to the picture/artwork.

Furthermore, the frame according to the invention is easy to reuse due to its simplicity and user-friendliness.

By the term picture/artwork is meant an object to be framed. Such object may be a canvas, a photograph, a poster, a plate with a self-made motif or a three-dimensional work of art.

The contact surface is the part of the frame facing the picture/artwork and to which the flexible member is attached.

The flexible member may cover the contact surface in part or completely.

The flexible member is compressible to such an extent that it can adapt to fit (small) variations in the contact surface of the frame or the periphery of the picture/artwork.

In a preferred embodiment according to the invention the flexible member creates a gap of approximately 5 mm between the inside of the frame members and the periphery of the picture/artwork. The flexible member is configured to exert a radial force (and thus a pressure) or a friction force against the picture/artwork in that way maintaining the picture/artwork in its position within the frame.

Small variations (notches and protrusions) may be within e.g. 0.1-15 mm, such as 0.2-5 mm for small pictures (e.g. pictures of 20 cm×20 cm); whereas small variations may be e.g. 1-20 mm such as e.g. 2 -10 mm for large pictures (e.g. 100 cm×100 cm). The flexible member may fit the frame and the picture even if small variations are present.

Loaded conditions are present when a force is exerted against the flexible member, while unloaded conditions are present when no force is applied.

It may be an advantage that the frame is constructed in such a manner that the picture/artwork can be mounted from both sides of the opening.

It may be possible to apply both sides of the frame, and one can turn the frame in order to change the colour or visual expression of the frame.

It may be advantageous that a groove is provided in at least a portion of the contact surface.

Hereby, it is possible to attach the flexible member in the groove. Accordingly, a simple and reliable attachment may be achieved.

It may be beneficial that a protrusion is provided in at least a portion of the contact surface. It is possible to attach the flexible member by means of the protrusion.

It may be an advantage that the frame comprises a number of frame members, and that the at least one flexible member is attached to one or more (preferably all) of the frame members by means of a groove and/or a protrusion of a frame member.

Hereby, it is easy to ensure an accurate position of the at least one flexible member on the contact surface. Further, it is easy to attach or replace the flexible member.

It may be an advantage that the contact surface is plane and that the at least one flexible member is attached to the contact surface by means of fastening elements such as glue, nails, screws or staples.

Hereby, a reliable and solid attachment of the frame member and the at least one flexible member is achieved. The joint is capable of resisting a force of a certain magnitude.

The flexible member, which may be a rubber band, may be configured to absorb impact in case the picture/artwork is exposed to mechanical stress e.g. if the picture is accidently dropped on the floor.

It may be an advantage that the at least one flexible member is adapted to fit irregularities or unevenness of the frame and/or the picture/artwork.

Hereby, the frame may be used even if irregularities or unevenness are present on the frame and/or the picture/artwork. A smooth transition between the frame and the picture can be achieved.

Irregularities or unevenness may be small variations (notches and protrusions) between e.g. 0.1-15 mm, such as 0.2-5 mm for small pictures (e.g. pictures of 20 cm×20 cm). The flexible member may be configured to fit a picture or a frame with even larger variations of e.g. 1-20 mm, such as 2-10 mm if the picture is large (e.g. 100 cm×100 cm). Irregularities or unevenness may be present in the corner structures on a canvas It may be advantageous that the at least one flexible member extends basically along the entire width (along the axis X) of the contact surface of the frame member.

Hereby, it is possible to adjust the position of the picture/artwork along the entire width of the frame members. This solution is flexible and user-friendly.

A frame according to the invention may be used to frame two pictures/artworks at the same time. One picture/artwork may be mounted from one side of the frame while another picture/artwork may be mounted from the other side of the frame. Accordingly, one can have access to another image just by turning the frame if it is mounted on a wall. If the frame is hanging from a ceiling it is possible to display two pictures/artworks at the same time by means of the frame according to the invention.

It may be an advantage that two parallel flexible members extend along the contact surface of each frame member.

Hereby, it is possible to adjust the position of the picture/artwork along the width of the frame members. Furthermore, it is possible to apply two different materials with different mechanical properties or to use flexible members of different colours.

It may be advantageous that the flexible member is compressible to such an extent that the thickness of the flexible member can be reduced to less than 80% of the thickness of the flexible member in an unloaded condition.

Hereby, the flexible member may "level out" or fit the unevenness of the contact surface of the frame or of the periphery of the picture/artwork.

It may be beneficial that at least one flexible member does not extend along the entire length (along the axis Y) of one or more of the frame members. The flexible member may by way of example be positioned on the central portion of the frame members and extend along about half the length of the frame members.

Hereby, it is possible to reduce costs by reducing the use of flexible members. Moreover, it may be easier to mount and dismount the picture/artwork from the frame. Furthermore, it is possible to create an effect by providing a gap between the frame and the periphery of the picture/artwork.

It may be an advantage that the frame comprises a flexible member attached to the frame, where the flexible member is a one-piece body.

Hereby, it is possible to provide a simple solution that is easy to mount e.g. in a groove structure. It is possible to conceal the arched portions of the flexible member that will present in the corner regions.

It may be beneficial that at the flexible member is an elastic band e.g. a rubber band.

The use of an elastic rubber band may be combined with the use of a groove structure with a corresponding geometry (adapted to receive and maintain the rubber band). Rubber bands may be provided in any required thickness, width and quality.

It may be beneficial that the flexible member has a uniform cross section.

Hereby, it is easier to mount the flexible member in a groove extending along the length of the frame members.

It may be an advantage that the flexible member is at least partly attached to the frame by means of press fit. Accordingly, the flexible member can be attached to the frame in a fast and easy manner. Press fit may be combined with use of other fastening means such as glue by way of example.

DESCRIPTION OF THE DRAWINGS

The invention will become more fully understood from the detailed description given herein below. The accompanying drawings are given by way of illustration only, and thus, they are not limitative of the present invention. In the accompanying drawings.

DETAILED DESCRIPTION OF THE INVENTION

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. In the following, identical or corresponding elements will have the same reference numbers.

Figure 1:
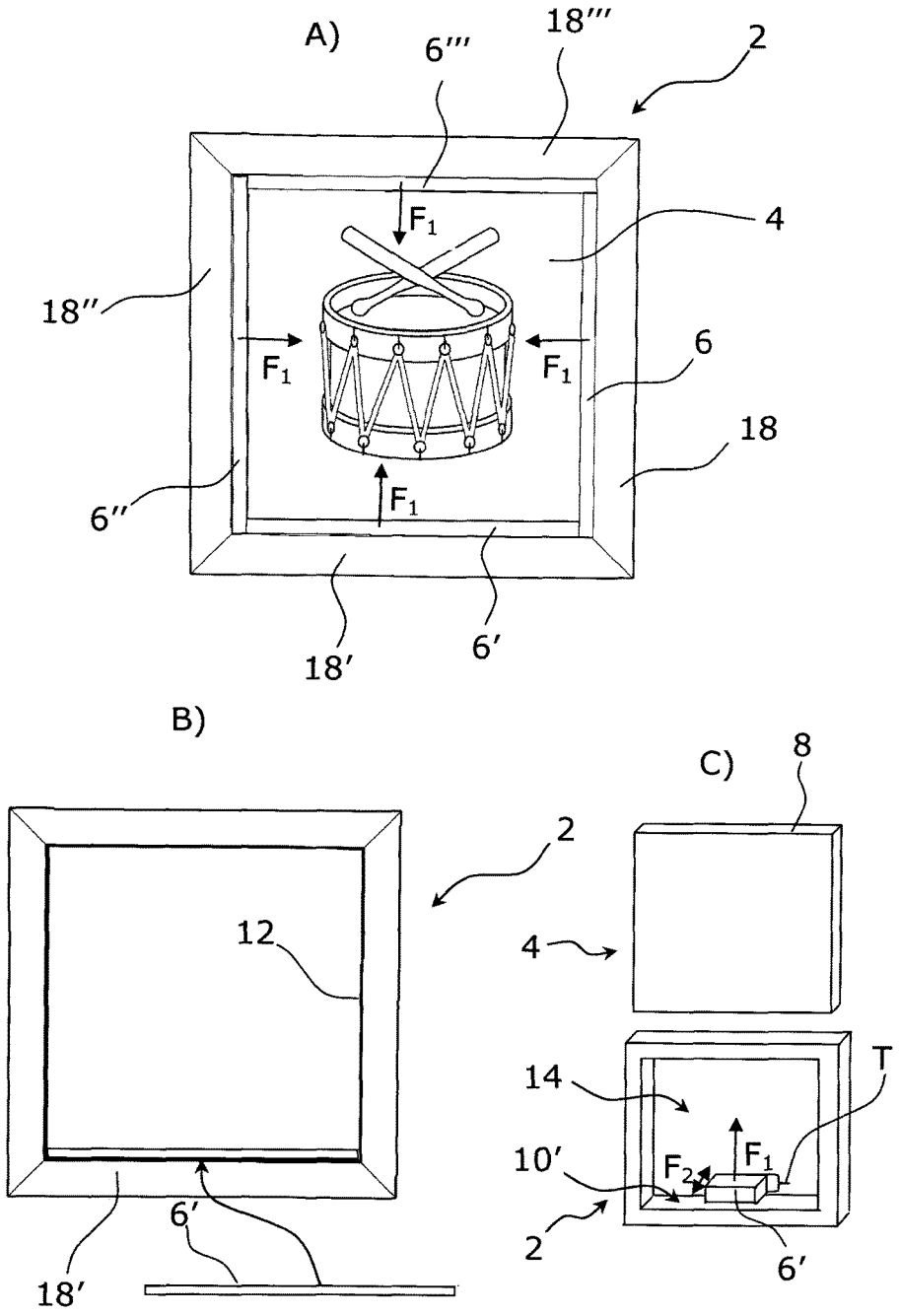
FIG. 1 shows schematic views of a frame according to the invention.

FIG. 1 A illustrates a square frame 2 comprising four frame members 18, 18', 18", 18'''. One flexible member 6, 6', 6", 6''' is attached to each of the frame members 18, 18', 18", 18'''. The flexible members 6, 6', 6", 6''' extend along the entire length of the frame member 18, 18', 18", 18' to which they are attached.

A picture/an artwork 4 is mounted in the frame 2. The four flexible member 6, 6', 6", 6''' are compressed by the picture/artwork 4. Hereby, a force $F_1$ is exerted towards the picture/artwork 4. The force $F_1$ is capable of maintaining the picture/artwork 4 within the frame 2.

FIG. 1B illustrates how to insert a flexible member 6' to the contact surface of the inside 12 of the frame 2. When the flexible member 6' has been attached to the contact surface of the inside 12 of the frame 2, the flexible member 6' extends along the entire length of the inside 12 of the frame member 18'.

FIG. 1 C illustrates how a flexible member 6' can exert a force $F_1$ radially and/or a friction force $F_2$ axially to the periphery 8 of the picture/artwork 4, respectively, when the picture/artwork has been mounted within the frame 2 through its opening 14.

The force $F_1$ secures that the picture/artwork 4 is kept in the central area within the frame 2. Thus, the force $F_1$ secures the position of the picture/artwork 4 along the length of the frame members of the frame 2. The force $F_2$ secures that the picture/artwork 4 is kept in place and thus is not displaced out of the frame 2. The thickness T of flexible member 6' is indicated in FIG. 1 C.

Figure 2:
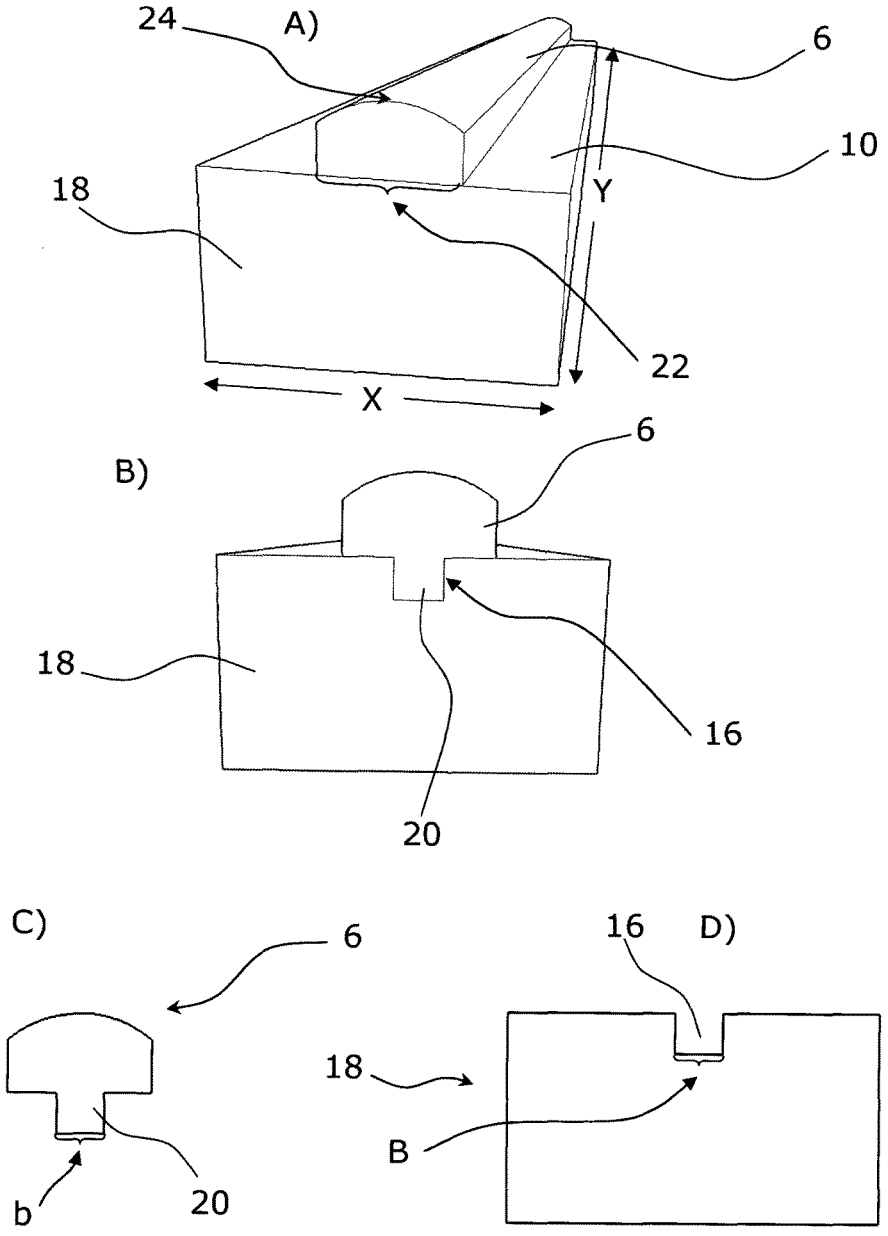
FIG. 2 schematically shows different views of a frame member provided with a groove.

FIG. 2 A illustrates an embodiment of a frame member 18 according to the invention. The frame member 18 comprises a flexible member 6 which does not cover the entire contact surface 10 (along the axis X). The flexible member 6 is attached to the frame member 18. The flexible member 6 is shaped with an arched profile 24. The arched profile 24 extends along the contact surface 10 and is configured to receive and abut the periphery of the picture/artwork to be framed by means of a frame comprising the frame member 18. The contact surface 22 between the flexible member 6 and the frame member 18 is plane and smooth.

FIG. 2 B, FIG. 2 C and FIG. 2 D illustrate a cross-sectional view of a frame member 18 joint with a flexible member 6 by means of a groove 16 provided in the frame member 18 (see FIG. 2 D).

The flexible member 6 is provided with a protrusion 20 (see FIG. 2 C) fit and shaped to be received by the groove 16. It may be an advantage to provide a protrusion 20 that is slightly larger (e.g. 0.1-5 mm) than the groove 16 in order to secure the most optimal fit between the protrusion 20 and the groove 16.

Figure 3:
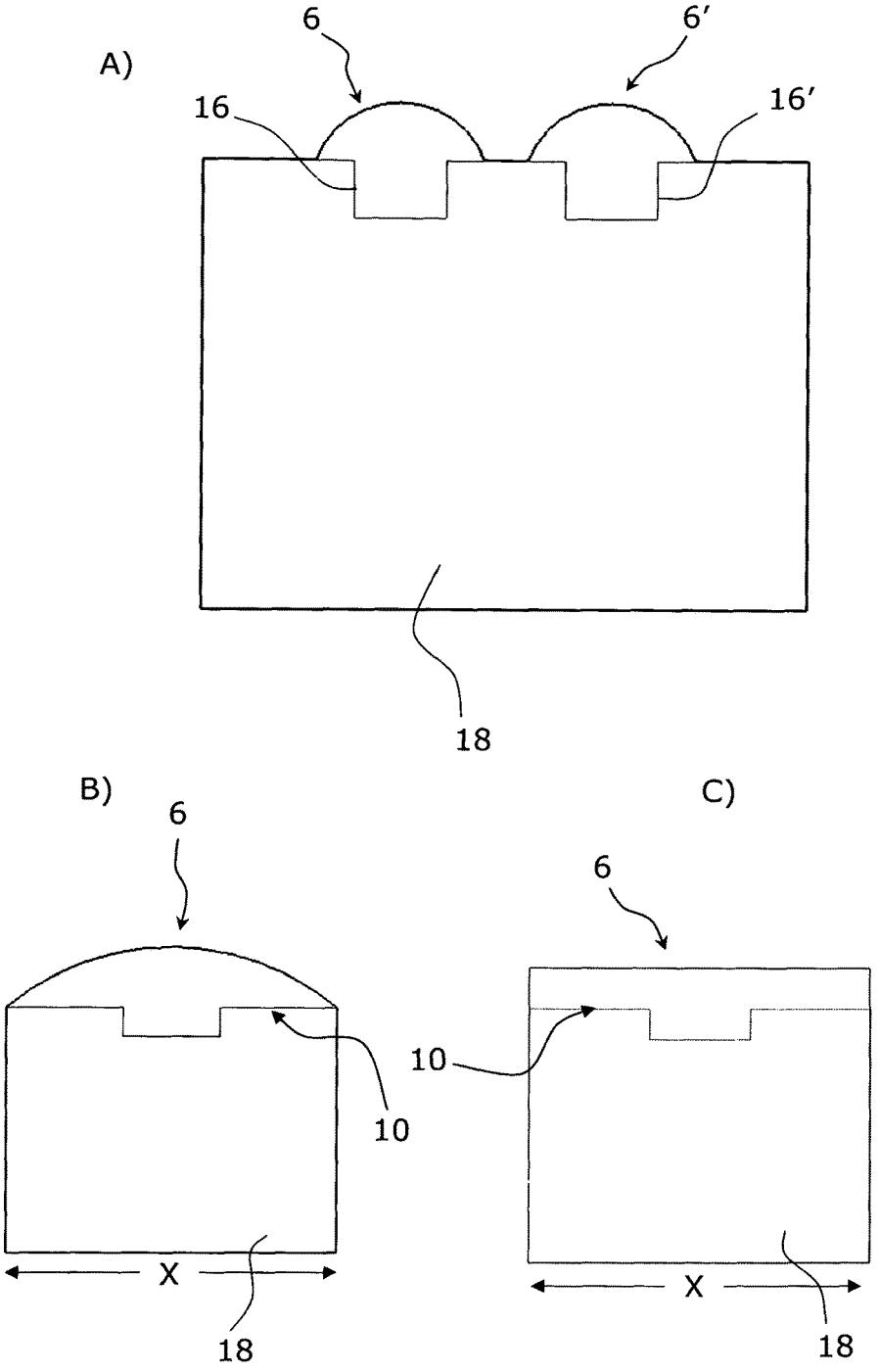
FIG. 3 shows different frame members according to the invention.

FIG. 3 A illustrates a frame member 18 provided with two parallel flexible member 6, 6' attached to the frame member 18 by means of two parallel grooves 16, 16'.

FIG. 3 B illustrates a frame 18 provided with a flexible member 6 having an arched upper surface. The flexible member 6 extends along the entire axis X (width) of the frame member 18. Accordingly, the flexible member 6 covers the entire contact surface 10 of the frame member 18. The flexible member 6 is provided with a protrusion that is received by a corresponding groove provided in the frame member 18.

FIG. 3 C illustrates a frame member 18 comprising a flexible member 6 with a rectangular shape. The flexible member 6 extends along the entire width (along the axis X) of the frame member 18. The flexible member 6 is provided with a protrusion that is received by a corresponding groove provided in the frame member 18.

Figure 4:
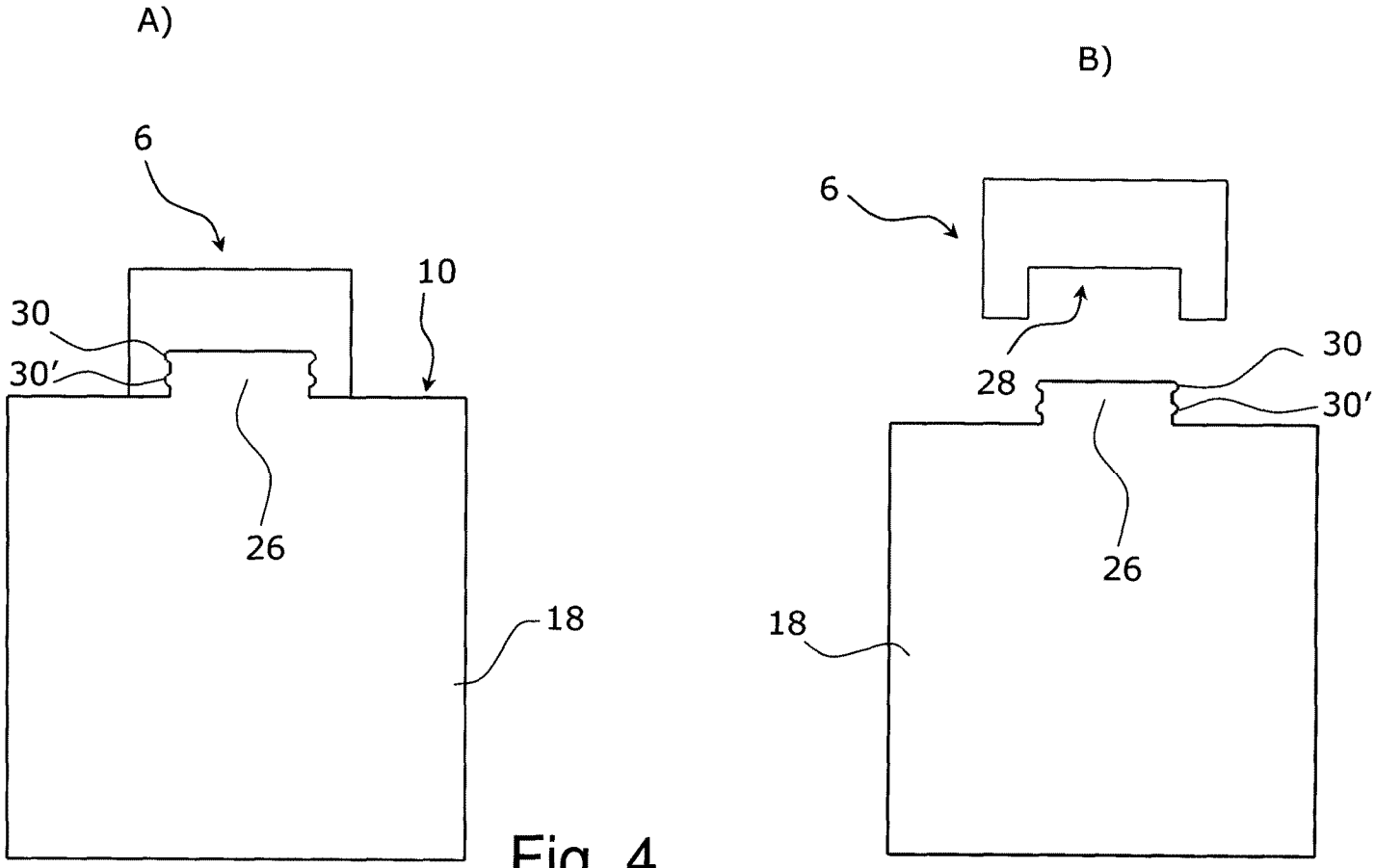
FIG. 4 shows a frame member provided with a barbed protrusion.

FIG. 4 A and FIG. 4 B illustrate a frame member 18 provided with a barbed protrusion 26. The protrusion 26 is provided with barbs 30, 30' and is arranged centrally at the contact surface 10 of the frame member 18. The flexible member 6 is attached to the barbed protrusion 26. The barbs 30, 30' improve the fixation of the flexible member 6 and the protrusion 26. The flexible member may be provided with another geometry fit to be received by the protrusion 26.

Figure 5:
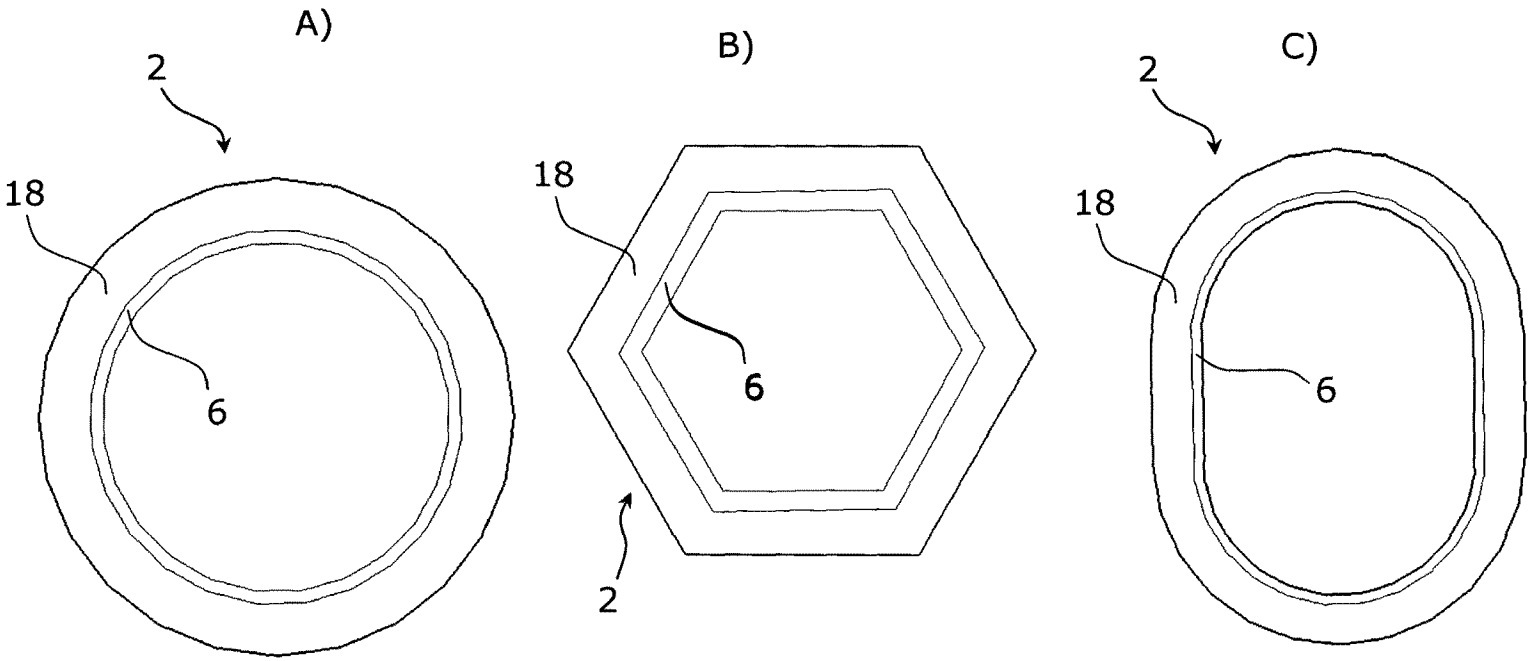
FIG. 5 shows different embodiments of a frame according to the invention.

FIG. 5 A, FIG. 5 B and FIG. 5 C illustrate differently shaped frames 2. All three embodiments comprise at least one frame member 18 and at least one flexible member 6. FIG. 5 A illustrates a circular frame 2, FIG. 5 B illustrates a hexagonal frame 2, while FIG. 5 C illustrates an oval frame 2.

Figure 6:
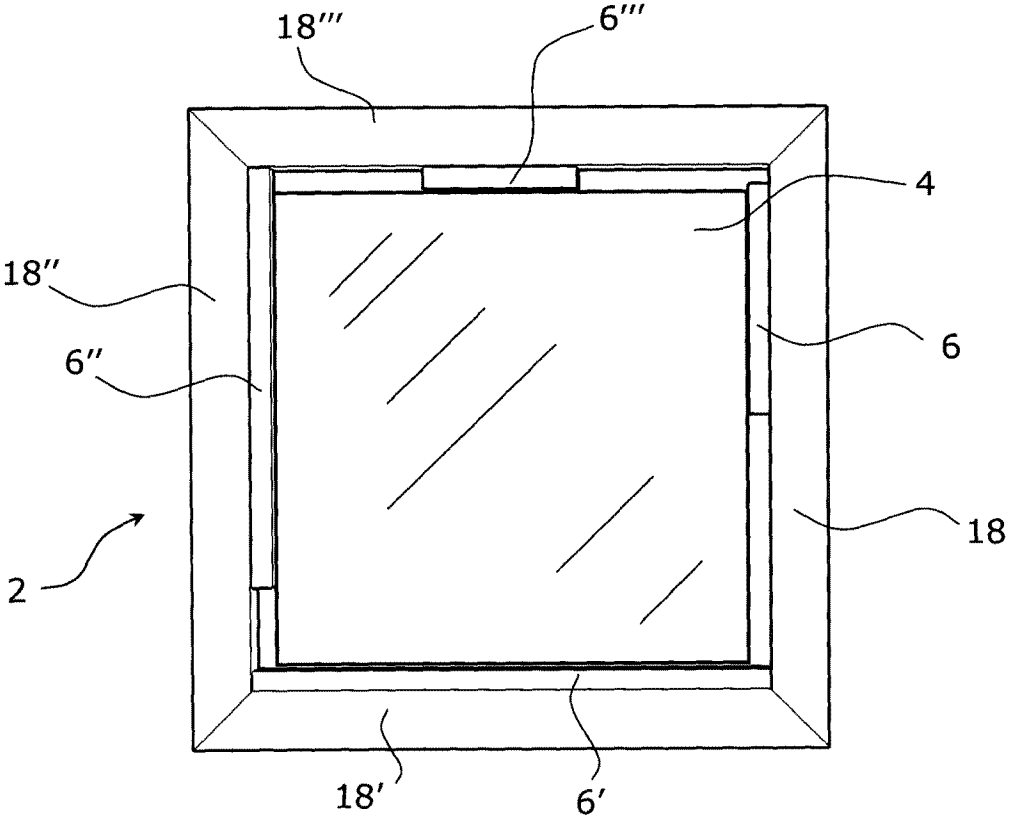
FIG. 6 shows a frame in which the flexible member does not extend along the total length of the frame members.

FIG. 6 illustrates a frame 2 according to the invention. The frame 2 comprises four flexible members 6, 6', 6", 6'''. Three of the flexible members 6, 6", 6''' do not extend along the entire length of the frame members 18, 18", 18''' to which they are attached. Even though these flexible members 6, 6", 6''' do not extend along the entire length of the frame members 18, 18", 18''', they are capable of maintaining the picture/artwork 4 firmly within the frame 2.

Figure 7:
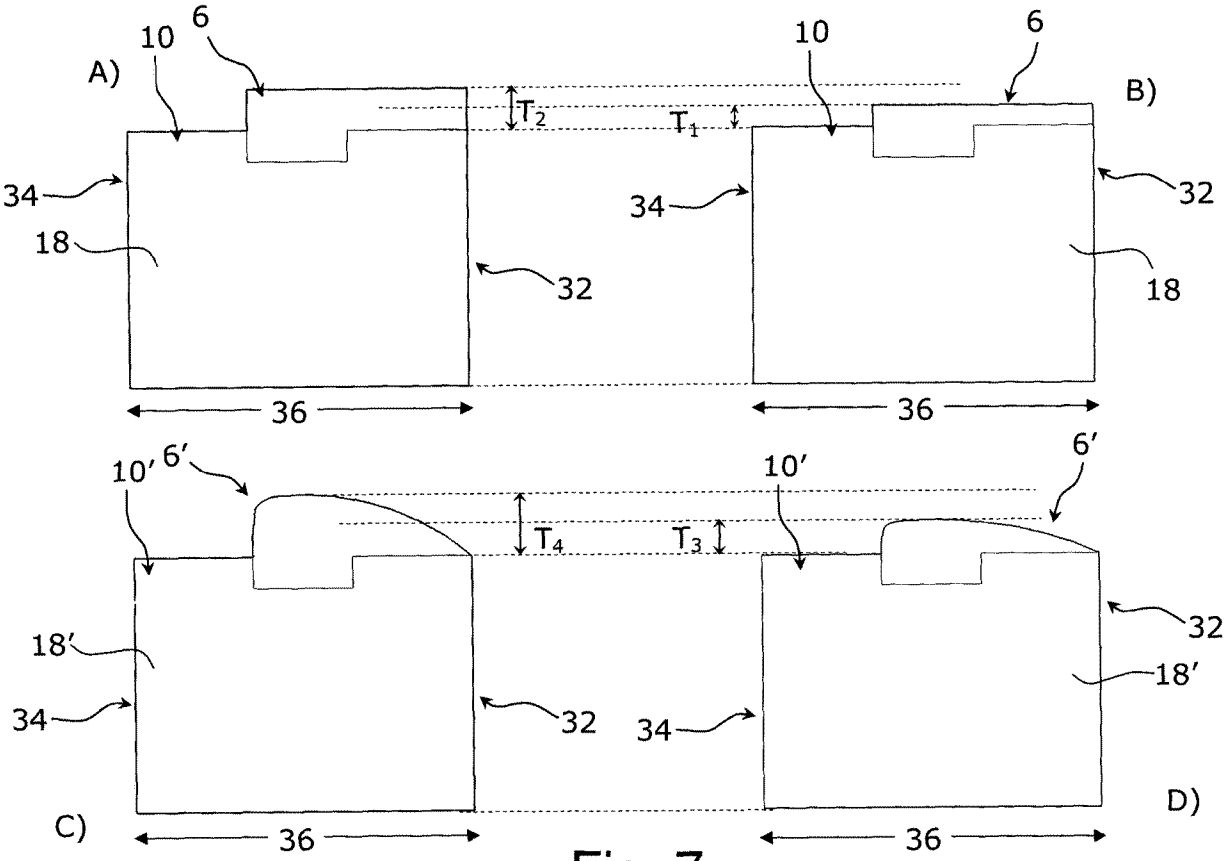
FIG. 7 shows two frame members with flexible members during loaded and unloaded conditions

FIG. 7 A illustrates a first frame member 18 of a frame according to the invention. The first frame member 18 has a rectangular cross-sectional area; A groove is provided in the central portion of the contact surface 10 of the frame member 18.

A flexible member 6 (e.g. a rubber band) is attached to the groove of the frame member 18. The flexible member 6 extends to the first edge 32 of the frame member 18. The flexible member 6 does not extend to the second edge 34 of the frame member 18. FIG. 7 A shows that the flexible member 6 does not extend along the entire width 36 of the frame member 18. The flexible member 6 is unloaded (no force is applied to it) and the thickness of the part of the flexible member provided above the contact surface 10 is $T_2$.

FIG. 7 B illustrates the frame member 18 shown in FIG. 7 A. The flexible member 6 of the frame member 18 is shown in a loaded condition (a force is applied to it). Accordingly, the thickness of the part of the flexible member 6 that is provided above the contact surface 10 is $T_1$. The part of the flexible member 6 provided above the contact surface 10 is compressed to such an extent that its thickness $T_1$ is reduced significantly (with approximately 50%) compared with the thickness $T_2$ during unloaded conditions (see FIG. 7 A).

The scenario illustrated in FIG. 7 B will occur when a picture/artwork is arranged in a frame provided with the illustrated frame members 18.

The periphery of the picture/artwork will compress the flexible member 6 and thus reduce the thickness $T_1$ of the flexible member 6.

FIG. 7 C illustrates a frame member 18' corresponding to the one illustrated in FIG. A and FIG. 7 B. The frame member 18' is provided with a groove into which groove a flexible member 6' is attached. The flexible member is unloaded (no forces is applied to it). The thickness of the part of the flexible member provided above the contact surface 10' is $T_4$.

The frame member 18' has a rectangular, cross-sectional area. A groove is provided in the central portion of the contact surface 10' of the frame member 18'.

The flexible member 6' extends to the first edge 32 of the frame member 18'. The flexible member 6' does not extend to the second edge 34 of the frame member 18'. FIG. 7 C shows that the flexible member 6' does not extend along the entire width 36 of the frame member 18'.

FIG. 7 D illustrates the frame member 18' shown in FIG. 7 C. The flexible member 6' of the frame member 18' is shown in a loaded condition (a force is applied to it). Accordingly, the thickness of the part of the flexible member 6' provided above the contact surface 10' is $T_3$.

The part of the flexible member 6' provided above the contact surface 10' is compressed to such an extent that its thickness $T_3$ is reduced significantly (with approximately 50%) compared with the thickness $T_4$ during unloaded conditions (see FIG. 7 C).

The scenario illustrated in FIG. 7 D will occur when a picture/artwork is arranged in a frame provided with the illustrated frame members 18'.

The periphery of the picture/artwork will compress the flexible member 6' and thus reduce the thickness $T_3$ of the flexible member 6'.

Figure 8:
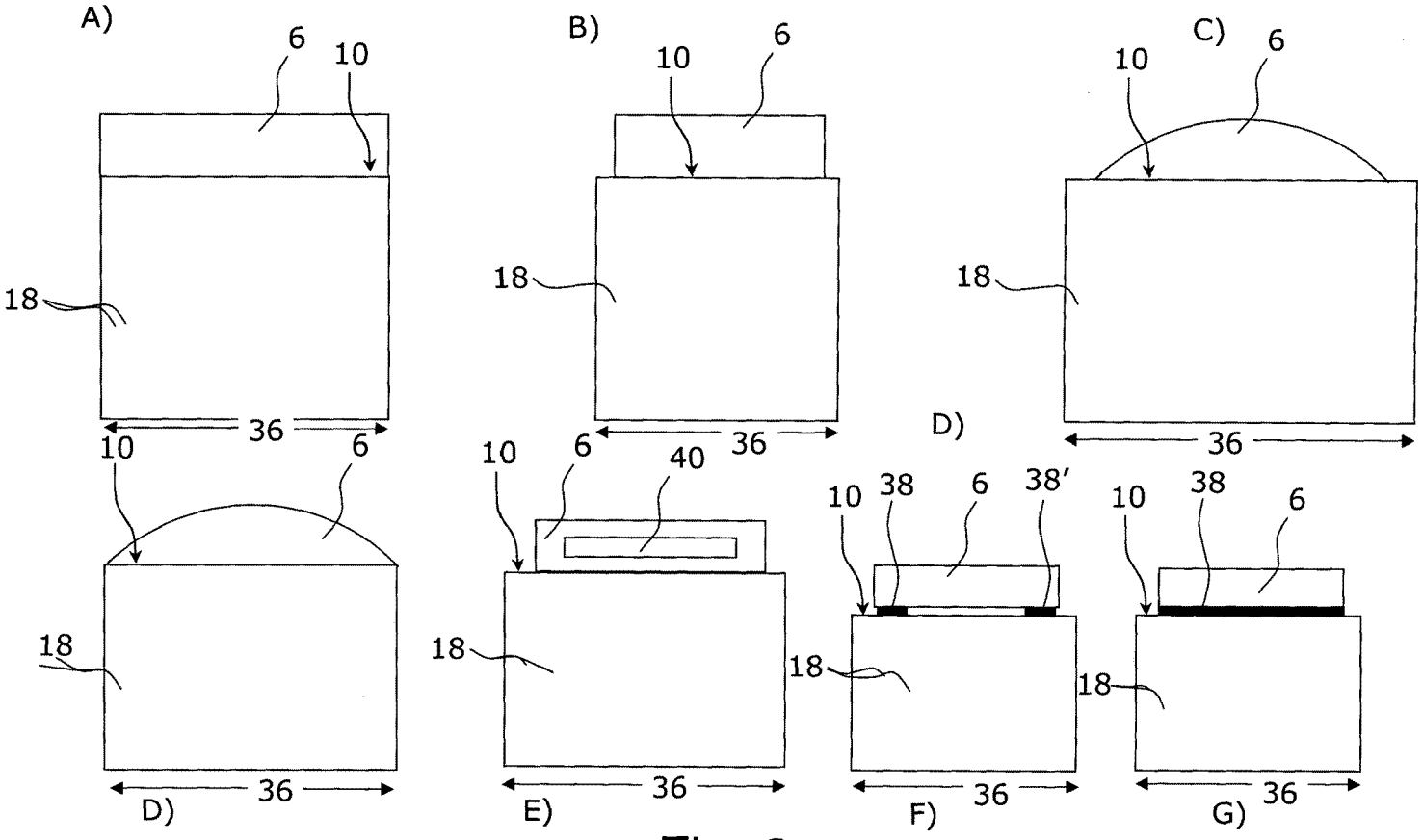
FIG. 8 illustrates a number of different frame members according to the invention and FIG. 9 illustrates two additional frame members according to the invention.

FIG. 8 illustrates a number of different frame members 18 according to the invention.

FIG. 8 A illustrates a frame member 18 having a square cross section. A flexible member 6 having a basically rectangular cross section is attached to the contact surface 10 of the frame member 18. The flexible member 6 extends along the entire width 36 of the frame member 18.

FIG. 8 B illustrates a frame member 18 having a rectangular cross section. A flexible member 6 having a rectangular cross section is attached to the contact surface 10 of the frame member 18. The flexible member 6 extends along the main portion (approximately 85%) of the width 36 of the frame member 18.

FIG. 8 C illustrates a frame member 18 having a rectangular cross section. A flexible member 6 having an arced profile is attached to the contact surface 10 of the frame member 18. The flexible member 6 extends along the main portion (approximately 80%) of the width 36 of the frame member 18.

FIG. 8 D illustrates a frame member 18 having a rectangular cross section. A flexible member 6 having an arced profile is attached to the contact surface 10 of the frame member 18. The flexible member 6 extends along the entire width 36 of the frame member 18.

FIG. 8 E illustrates a frame member 18 having a rectangular cross section. A hollow flexible member 6 having a rectangular cross section is provided with a cavity 40 is attached to the contact surface 10 of the frame member 18. The flexible member 6 extends along the main portion (approximately 80%) of the width 36 of the frame member 18.

FIG. 8 F illustrates a frame member 18 having a rectangular cross section. A flexible member 6 having a rectangular cross section is attached to the contact surface 10 of the frame member 18 by means of two portions of glue 38, 38'. The flexible member 6 extends along the main portion (approximately 80%) of the width 36 of the frame member 18.

FIG. 8 G illustrates a frame member 18 having a rectangular cross section. A flexible member 6 having a rectangular cross section is attached to the contact surface 10 of the frame member 18 by means of one large portion of glue 38. The flexible member 6 extends along the main portion (approximately 80%) of the width 36 of the frame member 18.

Figure 9:
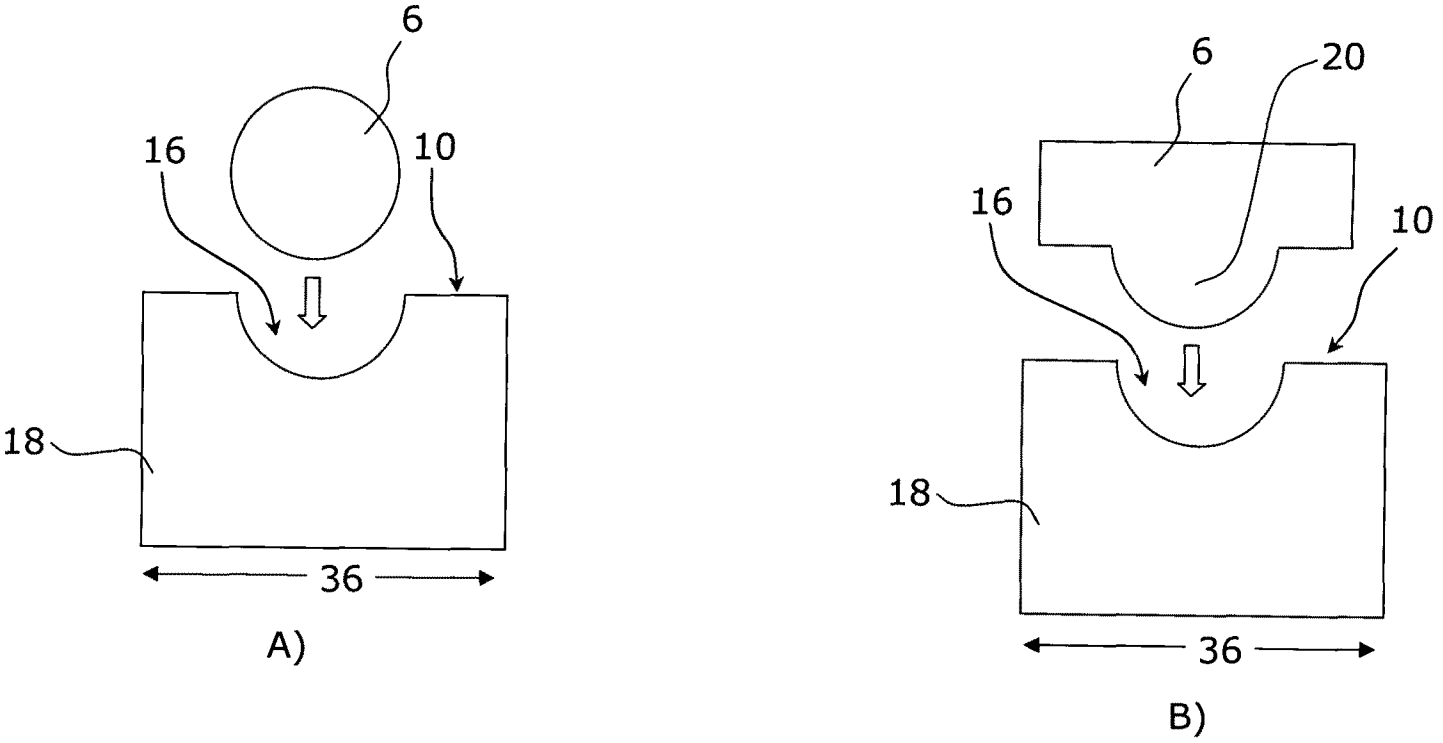

FIG. 9 A illustrates a frame member 18 having a rectangular cross section. The frame member 18 is provided with a groove 16 having a semi-circular cross section. A flexible member 6 having a circular cross section is provided above the groove 16 and above the contact surface 10 of the frame member 18. The flexible member 6 is shaped to be received by the groove 16 provided within the frame member 18. Glue may be used to attach the flexible member 6 to the frame member 18.

FIG. 9 B illustrates a frame member 18 having a rectangular cross section. The frame member 18 is provided with a groove 16 having a semi-circular cross section. A flexible member 6 having a rectangular cross section is provided with a protrusion 20 having a semi-circular cross section. The flexible member 6 is provided above the groove 16 and above the contact surface 10 of the frame member 18. The protrusion 20 of the flexible member 6 is shaped to be received by the groove 16 provided within the frame member 18. Glue may be used to attach the flexible member 6 to the frame member 18.

LIST OF REFERENCE NUMERALS

2 Frame
4 Picture/artwork
6, 6', 6", 6'" Flexible member
8 Periphery
10, 10' Contact surface
12 Inside (of the frame)
14 Opening
16 Groove
18, 18', 18", 18'" Frame member
20 Protrusion
22 Contact surface
24 Arced profile
26 Protrusion
28 Groove
30, 30' Barb

32, 34 Edge
36 Width
38, 38' Glue/adhesive
40 Cavity
B Width
b Width
$F_1$ Force
$F_2$ Friction force
T, $T_1$, $T_2$, $T_3$, $T_4$ Thickness
X Axis
Y Axis

The invention claimed is:

1. A stand-alone frame having an outer periphery and an inner periphery for framing a singular picture/artwork that is separate from the stand-alone frame before mounting within the stand-alone frame, the singular picture/artwork having a periphery, the stand-alone frame comprising at least one frame member having a contact surface provided on at least part of the inner periphery of the stand-alone frame, the inner periphery of the stand-alone frame presenting an opening larger than the singular picture/artwork in which the singular picture/artwork is mountable, and where at least one flexible member has a bottom surface that is attached to at least a portion of the contact surface on the inner periphery of the at least one frame member and has a top surface that provides both a compression force and a friction force between the at least one flexible member and the periphery of the singular picture/artwork when the singular picture/artwork is loaded into the stand-alone frame and fixed in place on the top surface of the at least one flexible member for presentation, wherein the contact surface along an entire width of the at least one frame member has a level lower than the top surface of the at least one flexible member above the contact surface in an unloaded and a loaded condition, where the top surface of the flexible member above the contact surface in the unloaded and the loaded condition will be nearest to the center of the frame than any other part of the frame, thereby the singular picture/artwork is mountable through the opening approached from either a front side of the stand-alone frame or a rear side of the stand-alone frame with the opening unobstructed when approached from either the front side or the rear side, wherein the at least one flexible member is only compressible in a direction away from the periphery of the singular picture/artwork, wherein the stand-alone frame is for mounting the singular picture/artwork within the stand-alone frame as a stand-alone framed singular picture/artwork suitable for stand-alone display without any obstruction from either a front side view or a rear side view of the stand-alone framed singular picture/artwork when fixed in place on the at least one flexible member for presentation.

2. The frame according to claim 1, wherein a groove is provided in at least a portion of the contact surface on the inner periphery of the at least one frame member, wherein a protrusion is provided in at least a portion of the at least one flexible member, the protrusion is inserted into the groove to attach the at least one flexible member to the inner periphery of the at least one frame member.

3. The frame according to claim 2, wherein a protrusion is provided in a portion of the contact surface of the inner periphery of the at least one frame member and a groove is provided in a portion of the at least one flexible member, and the at least one flexible member is attached to the inner periphery of the at least one frame member by insertion of the protrusion into the groove.

4. The frame according to claim 1, wherein the frame comprises a plurality of frame members, and the at least one flexible member is attached to one or more of the frame members by means of at least one of a groove provided in a portion of the contact surface of the one or more of the frame members and a protrusion provided in a portion of the at least one flexible member.

5. The frame according to claim 1, wherein the contact surface is plane, and the top surface of the at least one flexible member is flat in the unloaded condition and remains flat when compressed in the loaded condition.

6. The frame according to claim 1, wherein the at least one flexible member extends along an entire width of the contact surface on the inner periphery of the at least one frame member.

7. The frame according to claim 1, wherein two parallel, flexible members extend along the contact surface on the inner periphery of the at least one frame member.

8. The frame according to claim 1, wherein the at least one flexible member has a thickness that is compressible in the loaded condition so that the top surface of the at least one flexible member is flattened in the loaded condition.

9. The frame according to claim 1, wherein the at least one flexible member extends along an entire length of one or more of the at least one frame member.

10. The frame according to claim 1, wherein the at least one flexible member is a solid, one-piece body.

11. The frame according to claim 10, wherein the at least one flexible member is rectangular in cross-section.

12. The frame according to claim 1, wherein the at least one flexible member is an elastic band.

13. The frame according to claim 1, wherein the at least one flexible member has a uniform rectangular cross-section along an entire length of the at least one flexible member.

14. The frame according to claim 1, the at least one flexible member is at least partly attached to the frame by means of a press fit.

15. The frame according to claim 1, wherein a protrusion is provided in at least a portion of the contact surface of the inner periphery of the at least one frame member and wherein the at least one flexible member is attached to the protrusion by insertion of the protrusion in a groove of the at least one flexible member.

16. The frame according to claim 1, wherein a semicircular depression is provided in at least a portion of the contact surface of the inner periphery of the at least one frame member and wherein the at least one flexible member is attached to the depression by a semicircular protrusion provided on the at least one flexible member.

17. The frame according to claim 1, wherein the singular picture/artwork fits inside the opening with a space between the contact surface of the inner periphery of the at least one frame member and the periphery of the picture/artwork that is smaller than a space between the contact surface of the inner periphery of the at least one frame member and an unloaded thickness of the at least one flexible member above the contact surface of the inner periphery of the at least one frame member, wherein the singular picture/artwork is securely maintained in the frame by the compression force, by the friction force, or by both the compression force and the friction force, wherein the friction force allows the picture/artwork to be moved across the top surface of the at least one flexible member.

18. The frame according to claim 1, wherein the at least one flexible member is rectangular in cross-section and has a rectangular cross-sectional cavity in a hollow part thereof.

19. A frame for framing a picture/an artwork that is separate from the frame, the picture/artwork having a periphery, which frame comprises a plurality of frame members each with a frame member contact surface having an inside length and inside width provided at an inside of the frame to form an outer frame opening larger than the picture/artwork in which the picture/artwork is mountable when approached from either a front side of the frame or a rear side of the frame, and where an outer surface of at least one flexible member is attached to at least a portion of the inside width and to at least a portion of the inside length of the frame member contact surface of at least two opposing frame members to form an inner frame opening delineated by an inner surface of the at least one flexible member that in an unloaded condition of the frame is smaller than the picture/artwork so that when mounting the picture/artwork into the inner frame opening a friction fit is made between the periphery of the picture/artwork and at least part of the inner surface of the at least one flexible member that is flatten by compression resulting in a loaded condition of the frame with the picture/artwork mounted inside the frame, wherein there are respective loaded and unloaded nonzero gaps in the loaded and unloaded conditions between the frame member contact surface of each of the at least two opposing frame members and the at least part of the inner surface of the at least one flexible member, and wherein the loaded nonzero gap is smaller than the unloaded nonzero gap, wherein the inner surface of the at least one flexible member is entirely within the loaded nonzero gap in the loaded condition, and wherein the picture/artwork is securely maintained in the frame by a compression force, by a friction force, or by both the compression force and the friction force, wherein the friction force permits positioning of the picture/artwork by movement of the picture/artwork across the inner surface of the at least one flexible member.

20. A frame for framing a picture/an artwork that is separate from the frame, the picture/artwork having a periphery, which frame comprises at least one frame member having a frame member contact surface provided at an inside of the frame to form an outer frame opening larger than the picture/artwork in which the picture/artwork is mountable, and where at least one flexible member is attached to at least a portion of an entire width of the frame member contact surface on an inner periphery of the at least one frame member to form an inner frame opening that in an unloaded condition is smaller than the picture/artwork so that when mounting the picture/artwork into the inner frame opening a friction fit is made between the periphery of the picture/artwork and the at least one flexible member that is flatten by compression and thereby the picture/artwork is in a loaded condition inside the frame, wherein there are respective loaded and unloaded gaps in the loaded and unloaded conditions between the frame member contact surface along at least the portion of the entire width on the inside of the frame and thereby the picture/artwork is mountable through the outer frame opening approached from either a front side of the frame or a rear side of the frame and wherein a top surface of the at least one flexible member is within the loaded gap and entirely outside the periphery of the picture/artwork in the loaded condition, and wherein the picture/artwork is securely maintained in the frame by a compression force, by a friction force, or by both the compression force and the friction force, wherein the friction force permits positioning of the picture/artwork by movement of the picture/artwork across the top surface of the at least one flexible member.

* * * * *